US005834736A

United States Patent [19]

Kawamura

[11] Patent Number: 5,834,736

[45] Date of Patent: Nov. 10, 1998

[54] GLOW PLUG WITH POROUS PTC ELEMENT IMPREGNATED WITH METAL THEREIN

[75] Inventor: Hideo Kawamura, Kanagawa, Japan

[73] Assignee: Isuzu Ceramics Research Institute Co., Ltd., Kanagawa, Japan

[21] Appl. No.: 901,446

[22] Filed: Jul. 28, 1997

Related U.S. Application Data

[63] Continuation of Ser. No. 426,695, Apr. 24, 1995, abandoned.

[30] Foreign Application Priority Data

Apr. 22, 1994 [JP] Japan ..... 6-107633

[51] Int. Cl.[6] ..... F23Q 7/00

[52] U.S. Cl. ..... 219/270; 219/541; 123/145 A

[58] Field of Search ..... 219/270, 267, 219/505, 541, 544; 123/145 A; 361/264, 266; 338/22 R, 225 D; 501/137, 136

[56] References Cited

U.S. PATENT DOCUMENTS

| | | | |
|---|---|---|---|
| 4,682,008 | 7/1987 | Masaka | 219/270 |
| 4,725,711 | 2/1988 | Minegishi et al. | 219/270 |
| 5,304,778 | 4/1994 | Dasgupta et al. | 219/270 |
| 5,519,187 | 5/1996 | Hinkle | 219/270 |

FOREIGN PATENT DOCUMENTS

| | | |
|---|---|---|
| 57-58301 | 4/1982 | Japan . |
| 61-36901 | 2/1986 | Japan . |
| 62-17520 | 1/1987 | Japan . |
| 135251 | 10/1972 | Netherlands . |

*Primary Examiner*—John A. Jeffery
*Attorney, Agent, or Firm*—Staas & Halsey

[57] ABSTRACT

An electric current self-controlling device is prepared by impregnating a porous structure of a PTC material with a fused form of aluminum in a vacuum so that it can act as a heat sensor with the contact area between the PTC material and aluminum being increased. The outer surface of the metal impregnating PTC structure is covered with insulating films of alumina and the PTC material is accompanied with an outer terminal 43 and the aluminum impregnating in the PTC material is connected with an inner terminal 44. A terminal screw 3, the current controller device 4, the heating coil 51, and a current limiting coil 52 are connected in series. Accordingly, the heating temperature of the heating coil 51 can be determined by controlling the flow of the energizing current from the terminal screw 3 with the positive temperature coefficient resistant action and nonlinear variable resistance action of the current controller device 4.

13 Claims, 2 Drawing Sheets

GLOW PLUG WITH POROUS PTC ELEMENT IMPREGNATED WITH METAL THEREIN

This application is a continuation of application Ser. No. 08/426,695, filed Apr. 24, 1995, now abandoned.

BACKGROUND OF THE INVENTION 1. (Field of the Invention)

The present invention relates to an electric current self-controlled device and a temperature self-controlling glow plug installed to a combustion chamber in a diesel engine, which is energized to ignite a spray of fuel for starting the engine.

2. (Description of the Prior Art)

A common diesel engine is provided with a glow plug for igniting a spray of fuel in a pre-chamber in order to promote the combustion of the fuel. More specifically, the glow plug is heated by energization with a battery so that its heated head ignites a blast of the fuel to start the engine.

The glow plug generally comprises a heating coil mounted at its head end and a controlling coil connected in series to the heating coil for limiting the flow of energizing current by increasing an electrical resistance thereof in response to the generation of heat by the current. Accordingly, a desired temperature on the glow plug can be obtained by controlling the flow of the energizing current from a battery to the glow plug.

If the atmospheric temperature is low, and thus the temperature in the combustion chamber remains low, thus discouraging the starting of the engine, the glow plug is used for preparatory heating. The supply of the energizing current to the glow plug is controlled with a timer which determines the duration of the heating depending on the atmospheric temperature.

The timer for determining the duration of preparatory heating in which the energizing current is supplied to the glow plug may be replaced with a heat sensor which monitors the temperature in the combustion chamber and varies its resistance in response to a change in the temperature so as to control the flow of the energizing current across the glow plug.

Preferably, the heat sensor is a positive temperature coefficient (PTC) thermistor utilizing a semiconductor. The PTC thermistor itself has a high electric resistance ($R=K\ L/A$) where K is a resistance coefficient as high as 100 Ωcm. To have about 0.01Ω of a desirable serial resistance in the glow plug, the PTC thermistor through which the energizing current passes has to be decreased considerably in the length or increased in the cross section.

SUMMARY OF THE INVENTION

The present invention is directed towards elimination of the foregoing problem and its object is to provide an electric current self-control device include the grow plug having an improved heat sensor which determines temperature required for ignition of a duel in response to the temperature in a combustion chamber, without using a conventional timer for controlling the supply of an energizing current to the device depending on the atmospheric temperature.

For achievement of the object of the present invention, an electric current self-control device plug for use with a combustion chamber in a diesel engine to controllably apply to its heating head a temperature required for ignition of fuel is provided comprising a heating coil provided in the heating head, and a heat sensor disposed in an appropriate location for detecting a temperature in the combustion chamber and having a positive temperature coefficient (PTC) material thereof, arranged to produce a lower electrical resistance with the use of a means for increasing the cross section across which an energizing current is passed to the heating coil. The heating coil and the heat sensor are connected to each other in series and accommodated in a sheath.

The means for increasing the cross section which is mounted in the heat sensor of the temperature self-controlling glow plug for having a lower electrical resistance may be formed by impregnating a porous structure of either barium titanate or lead titanate with a fused form of a metal material in a vacuum so that the contact area between the porous structure material and the metal material is increased. As described above, the PTC material of a porous structure having a positive temperature coefficient resistance and nonlinear variable resistance is impregnated with a fused metal material in a vacuum so that its contact area with the metal material is increased, thus optimizing the cross section across which an energizing current is passed and decreasing the electrical resistance. The heat sensor utilizing the PTC material can be varied in resistance in response to the conditions of combustion and the temperature of water about a cylinder head to control the flow of the energizing current to the heating coil connected in series.

DESCRIPTION OF THE PREFERRED EMBODIMENTS

Preferred embodiments of the present invention will be described in more details referring to the accompanying drawings.

Figure 1:
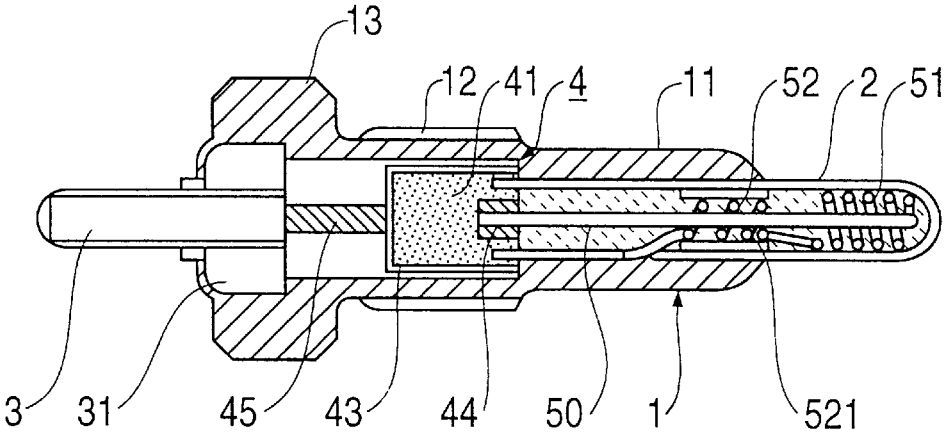
FIG. 1 is a cross sectional view of a temperature self-controlling glow plug showing one embodiment of the present invention.
Figure 2:
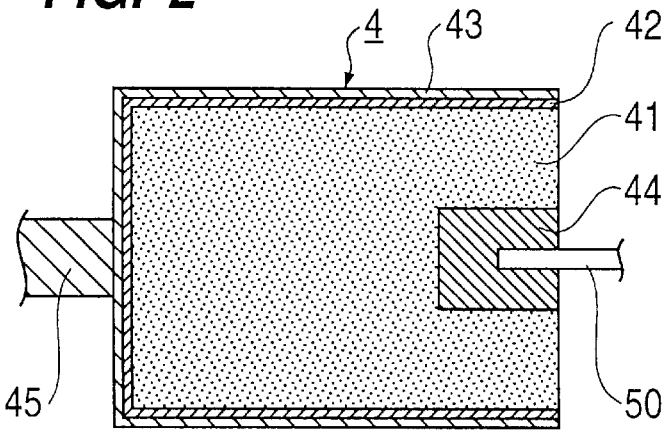
FIG. 2 is a cross sectional view of a current controller device mounted in a central region of the glow plug of the embodiment.

FIG. 1 is a cross sectional view of a temperature self-controlling glow plug showing one embodiment of the present invention. FIG. 2 is a cross sectional view showing a current controller device mounted to the center of the glow plug.

As shown, there are a metal housing 1 provided with a thread 12 and a nut 13 for securing, and a sheath 2 arranged so that its head extends from the front end of its casing 11 into a combustion chamber in an engine. A terminal screw 3 is fixedly fitted by an electrical insulator 31 into the center of the nut 13.

The sheath 2 may be composed of a tube being closed at the head end with a heat-resistant material, e.g. silicon nitride. The tube contains a heating coil 51 at the head, a current limiting coil 52 at the center, which is protected at an outer side with an insulating ceramic fiber 521, and a lead 50 extending along the axis of the tube. Spaces between the coils 51, 52 and the lead 50 in the tube are filled with a mixture of silicon nitride and titanium nitride. The healing coil 51 is connected at one end in series to the current limiting coil 52 and at the other end to the lead 50. The other end of the current limiting coil 52 is connected to a certain terminal in the housing 1. Accordingly, an energizing current introduced from a current controller device which will be described later runs from the lead 50 to the heating coil 51, the current limiting coil 52, and the housing 1, thus heating the head of the sheath 2. Also, the interior of the sheath 2 is tightly filled with a combination of Si3N4 and TiO2 or a sintered form of titanium nitride.

In FIG. 1 and FIG. 2, 4 denotes a current controller device, placed in a center region of the screw 12 of the housing 1. The current controller device 4 controls the flow of the energizing current to the heating coil 50 depending on combustion conditions including a water temperature and a combustion chamber temperature in order to maintain the head of the glow plug at a desired temperature for ignition of a fuel. In this embodiment of the present invention the current controlling device 4 comprises a heat sensor for control of the energizing current with the use of a positive temperature coefficient (PTC) and nonlinear variable resistance materials.

The PTC thermistor maybe composed of barium titanate (BaTiO3) or lead titanate (PbTiO3) either of which sharply increases its electrical resistance when the temperature rises to a given degree. It should however be noted that the resistance of such a material is high enough to allow only a large amount of the energizing current to flow through the heating coil 51. Because the flow of a large current to the heating coil is hardly controlled, it is desired that the material is either increased in the area of the cross section (A) or decreased in the length (L). As described previously, the resistance coefficient K of the material is as high as 100 Ωcm as the overall resistance R is expressed by R=K (L/A) where L is the length and A is the area of the cross section. It will be difficult to reduce the resistance R to about 0.01Ω of a desired value for the glow plug even if the dimensions of the material are modified. According to the present invention, the PTC thermistor material is formed of a porous structure of e.g. barium titanate or lead titanate and impregnated with a fused state of a low temperature fusing point metal especially aluminum in a vacuum. As a result, the porous structure of the PTC material is increased in the contact area with aluminum, thus declining its electrical resistance. It should be noted that as the PTC material has a relatively higher rate of the resistance coefficient K, its overall resistance may remain high if its volumetric ratio to aluminum is not appropriate. While the resistance coefficient K of aluminum is low, the volumetric ratio of the PTC material or namely, barium titanate in the embodiment to aluminum is substantially 2:1.

As shown in FIG. 2, a composite solid 41 is provided by impregnating a cylindrical porous structure of the PTC material with a fused state of aluminum in a vacuum. In addition, the composite solid 41 is subjected to oxidation thus causing its aluminum on the outer surface to turn to alumina (Al2O3) 42.

In FIG. 2, 43 denotes an enclosure or an outer terminal. Composite 41 is prepared by a porous structure of barium titanate impregnated with aluminum. The surface of aluminum impregnating in a porous is covered with films of alumina 42 for electrical insulation from a bottomed tubular enclosure 43 which is made of a metal material such as aluminum and serves as an outer terminal. While the enclosure or outer terminal 43 is disconnected by the alumina 42 from aluminum in the composite solid 41, it is directly connected to the PTC material. Also, an inner terminal 44 is provided by filling with aluminum a recess arranged in an exposed end of the composite solid 41. As shown in FIG. 1, the inner terminal 44 is coupled to the lead 50. The outer terminal 43 is connected by a lead wire 45 to the terminal screw 3.

The action of the embodiment will now be explained.

When the glow plug of the embodiment mounted by the thread 12 of its housing 1 to the combustion chamber is not energized before starting the engine, its heating head and current controller device 4 comprising the composite solid of the PTC material and aluminum and disposed in the housing 1 remain low in temperature due to a lower temperature of the combustion chamber with a cylinder head. At the time, the resistance of the current controller device 4 is low because of an increased contact area between the PTC material and the aluminum filled in the voids of the PTC material. Accordingly, a large flow of energizing current introduced from the terminal screw 3 is easily passed across the current controller device 4 to the heating coil 51 and the current limiting coil 52 which are connected in series. As a result, the heating coil 51 is energized, heating up the head of the sheath 2.

A blast of fuel upon being supplied into the combustion chamber is directly ignited by the heat of the sheath 2, promoting a combustion action in the engine. As the engine starts and the combustion of fuel is accelerated, a higher temperature generated in the combustion chamber is transferred from the sheath 2 via the housing 1 to the current controller device 4. Meanwhile, the electrical resistance of the PTC material has been increased due to the positive temperature coefficient effect during the flow of the current. When the resistance of the PTC material is increased to a predetermined rate by a combination of the higher temperature from the combustion chamber and the temperature of the glow plug itself, it will substantially interrupt the flow of the current to the heating coil 51. The control over the flow of the energizing current to the heating coil 51 by means of the PTC material of the current controller device 4 depends on a duration of the energization and the temperature in the combustion chamber. The flow of the energizing current to the heating coil 51 can thus be controlled automatically in response to the combustion action in the combustion chamber after starting the energization.

Figure 3:
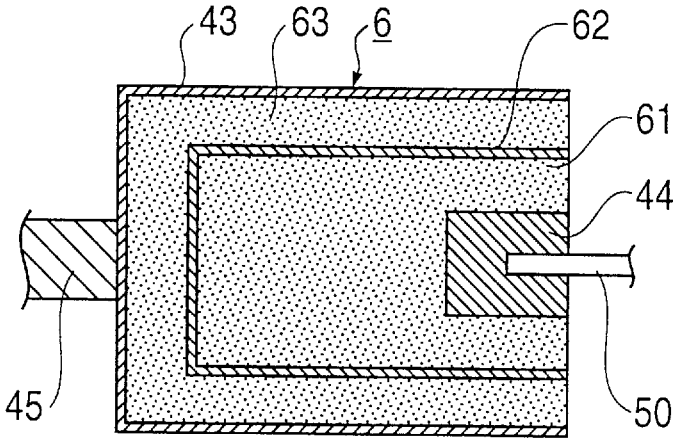
FIG. 3 is a cross sectional view of a current controller device showing another embodiment of the present invention.

FIG. 3 is a cross sectional view of a current controller device showing another embodiment of the present invention. The current controller device 6 is similar in construction to the heat sensor 4 of the previous embodiment utilizing the PTC thermistor material. In particular, a composite solid of the current controller device 6 prepared by impregnating a porous structure of the PTC material with a fused form of aluminum in a vacuum in the same manner as of the previous embodiment comprises an inner composite region 61 and an outer composite region 63. The composite solid is first heated for fusing and removing given portions of the aluminum from all the sides except the exposed side thus leaving the inner composite region 61. It is then subjected to oxidation to shift the aluminum on the outer edge of the inner composite region 61 to films of alumina 62. Finally, the remaining porous PTC material outside the alumina films 62 is impregnated again with a fused form of aluminum forming the outer composite region 63. Accordingly, the inner region 51 and the outer region 63 are electrically connected to each other by the PTC material although they are separated from each other by the alumina films 62. Similar to the previous embodiment, the inner composite region 61 is connected by an inner terminal 44 to the lead 50 and the outer composite region 63 is covered at a side wall and at one of two ends with an outer terminal 43 made of aluminum which is coupled to the lead wire 45. The current controller device or heatsensor 6 of this embodiment has also a lower electrical resistance due to the PTC material, thus allowing a large flow of energizing current to be easily passed to the heating coil connected in series for heating up the sheath head when the temperature of the combustion chamber remains low. A higher temperature generated by combustion actions in the combustion chamber is then transferred via the metal housing to the current controller device 6 which is in response increased in the resistance by the positive temperature coefficient effect of the PTC material thus attenuating the flow of the energizing current to the heating coil.

As set north above, the electric current self-control device including temperature self-controlling glow plug for use with a combustion chamber in a diesel engine to controllably apply to its heating head a temperature required for ignition of a fuel, according to the present invention allows a PTC material which has a high electrical resistance to be modified by an appropriate means for increasing the cross section across which an energizing current is passed so that the overall resistance thereof is decreased. The heat sensor utilizing the PTC material is connected in series to the heating coil, both being accommodated in a sheath. Accordingly, the flow of the energizing current to the heating coil can be controlled by the heat sensor in response to the conditions of combustion so as to produce the desired temperature for ignition of the fuel at the heading head of the glow plug, without the use of a conventional timer operable depending on the atmospheric temperature.

What is claimed is:

1. An electric current self-control device depending on temperature variation, comprising:

a porous positive temperature coefficient (PTC) element consisting of a nonlinear variable resistance material;

a metal which is impregnated in said PTC element to form a metal-impregnated PTC element having an optimized cross section across which an energizing current passes;

a first electrode, having an inner terminal, connected to said metal-impregnated PTC element;

said inner terminal of said first electrode formed in a recess of an end of said metal-impregnated PTC element;

a second electrode, having an outer terminal, connected to said metal-impregnated PTC element wherein said outer terminal covers a part of an outer surface of said metal-impregnated PTC element other than said recess; and a terminal supplying electric power to said heating coil and said device, whereby the flow of said energizing current is controlled in response to conditions of combustion.

2. An electric current self-control device depending on temperature variation according to claim 1, wherein said PTC element is either sintered barium titanate or sintered lead titanate.

3. An electric current self-control device depending on temperature variation according to claim 1, wherein said metal which is impregnated in said PTC element is a low temperature fusing point metal comprising aluminum.

4. An electric current self-control device depending on temperature variation according to claim 1, wherein said first and second electrode comprise aluminum.

5. An electric current self-control device depending on temperature variation according to claim 1, wherein the volumetric ratio of said PTC element to said metal is substantially 2:1 or more.

6. An electric current self-control device depending on temperature variation, comprising:

a porous positive temperature coefficient (PTC) pillar shaped first element consisting of a nonlinear variable resistance material;

a first metal which is impregnated in said porous portion of said PTC pillar shaped first element to form a first metal-impregnated pillar shaped PTC element having an optimized cross section across which an energizing current passes;

a porous positive temperature coefficient (PTC) second element consisting of a nonlinear variable resistance material surrounding said pillar shaped first element and connected to said nonlinear variable resistance material of said pillar shaped first element;

a second metal which is impregnated in said porous portion of said PTC second element to form a second metal-impregnated PTC element;

a first electrode, having an inner terminal, connected to said first metal-impregnated pillar shaped PTC element;

said inner terminal of said first electrode formed in a recess of an end of said first metal-impregnated PTC element;

a second electrode, having an outer terminal, connected to said second metal-impregnated PTC element wherein said outer terminal covers a part of an outer surface other than said recess; and a terminal supplying electric power to said device, whereby the flow of said energizing current is controlled in response to conditions of combustion.

7. A glow plug with an electric current self-control device depending on temperature variation, comprising:

a sheath fixed and protruded to a top of cylindrical housing;

a heating coil fixed in said sheath;

an electric current self-control device depending on temperature variation connected in series with said heating coil and fixed in said sheath;

wherein said electric current self-control device comprises:

a porous positive temperature coefficient (PTC) element consisting of a nonlinear variable resistance material;

a metal which is impregnated in said porous portion of said PTC element to form a metal-impregnated PTC element having an optimized cross section across which an energizing current passes;

a first electrode, having an inner terminal, connected to said metal-impregnated PTC element;

said inner terminal of said first electrode formed in a recess of an end of said metal impregnated PTC element;

a second electrode, having an outer terminal, connected to said metal-impregnated PTC element wherein said outer terminal covers a part of an outer surface other than said recess; and a terminal supplying power to said heating coil and said electric current self-control device, whereby the flow of said energizing current is controlled in response to conditions of combustion.

8. A glow plug with an electric current self-control device depending on temperature variation according to claim 7, wherein said PTC element is either sintered barium titanate or sintered lead titanate.

9. A glow plug with an electric current self-control device depending on temperature variation according to claim 7, wherein said metal which is impregnated in said PTC element is a low fusing point metal comprising aluminum.

10. A glow plug with an electric current self-control device depending on temperature variation according to claim 7, wherein said first and second electrode comprise aluminum.

11. A glow plug with an electric current self-control device depending on temperature variation according to claim 7, wherein the volumetric ratio of said PTC element to said metal is substantially 2:1 or more.

12. A glow plug with an electric current self-control device depending on temperature variation, comprising:

a sheath fixed and protruded to a top of cylindrical housing;

a heating coil fixed in said sheath;

an electric current self-control device depending on temperature variation connected in series with said heating coil and fixed in said sheath;

wherein said electric current self-control device comprises:

a porous positive temperature coefficient (PTC) pillar shaped first element consisting of a nonlinear variable resistance material;

a first metal which is impregnated in said porous portion of said PTC pillar shaped first element to form a first metal-impregnated pillar shaped PTC element having an optimized cross section across which an energizing current passes;

a porous positive temperature coefficient (PTC) second element consisting of a nonlinear variable resistance material surrounding said pillar shaped first element and connected to said nonlinear variable resistance material of said pillar shaped first element;

a second metal which is impregnated in said porous portion of said PTC second element to form a second metal-impregnated PTC element;

a first electrode, having an inner terminal, connected to said first metal-impregnated pillar shaped PTC element;

said inner terminal of said first electrode formed in a recess of an end of said first metal-impregnated PTC element;

a second electrode, having an outer terminal, connected to said second metal-impregnated PTC element wherein said outer terminal covers a part of an outer surface other than said recess; and a terminal supplying electric power to said heating coil and said electric current self-control device, whereby the flow of said energizing current is controlled in response to conditions of combustion.

13. An electric current self-control device depending on temperature variation, comprising:

a porous positive temperature coefficient (PTC) first element consisting of a nonlinear variable resistance material;

a first metal which is impregnated in said porous portion of said PTC first element to form a first metal-impregnated PTC element having an optimized cross section across which an energizing current passes;

a porous positive temperature coefficient (PTC) second element consisting of a nonlinear variable resistance material connected to said nonlinear variable resistance material of said first element;

a second metal which is impregnated in said porous portion of said PTC second element to form a second metal-impregnated PTC element;

a first electrode, having an inner terminal, connected to said first metal-impregnated pillar shaped PTC element;

said inner terminal of said first electrode formed in a recess of an end of said first metal-impregnated PTC element;

a second electrode, having an outer terminal, connected to said second metal-impregnated PTC element wherein said outer terminal covers a part of an outer surface other than said recess; and a terminal supplying electric power to said device, whereby the flow of said energizing current is controlled in response to conditions of combustion.

* * * * *